United States Patent [19]

Harvey

[11] 4,112,454

[45] Sep. 5, 1978

[54] METHOD AND APPARATUS FOR TREATING ELEMENTS OF PHOTOGRAPHIC FILM

[75] Inventor: Donald Malcolm Harvey, Rochester, N.Y.

[73] Assignee: Eastman Kodak Company, Rochester, N.Y.

[21] Appl. No.: 774,722

[22] Filed: Mar. 7, 1977

[51] Int. Cl.[2] ..... G03D 3/04

[52] U.S. Cl. ..... 354/330; 354/340; 134/157

[58] Field of Search ..... 134/64 P, 122 P, 139, 134/140, 149, 157, 158; 259/103, 106, 107, 108, 119, 121, 122; 354/312, 313, 314, 315, 316, 318, 319, 320, 321, 322, 326, 328, 329, 330, 331, 333, 335, 337, 340, 345

[56] References Cited

U.S. PATENT DOCUMENTS

| | | | |
|---|---|---|---|
| 608,871 | 8/1898 | Kirkwood | 134/139 |
| 750,621 | 1/1904 | Dorr | 354/329 |
| 1,373,311 | 3/1921 | Gorsky | 134/157 |
| 2,663,305 | 12/1953 | Anderes et al. | 134/158 |
| 2,766,670 | 10/1956 | Fritts | 354/345 |
| 3,693,529 | 9/1972 | Stabler | 354/306 |
| 3,727,620 | 4/1973 | Orr | 134/140 |
| 4,001,852 | 1/1977 | Gall | 354/313 |
| 4,011,573 | 3/1977 | Braico | 354/322 |

*Primary Examiner*—L. T. Hix
*Assistant Examiner*—Alan Mathews
*Attorney, Agent, or Firm*—J. A. Mathews

[57] ABSTRACT

A processor and processing method for treating flat discrete elements of photographic film, preferably in a disc format, includes the use of a spindle for receiving the elements in stacked, parallel relation normal to the spindle. The spindle mounted discs are rotated in a processing solution to provide relative movement between the discs and the solution, and are rotated while out of the processing solution to remove excess solution from the discs.

8 Claims, 6 Drawing Figures

METHOD AND APPARATUS FOR TREATING ELEMENTS OF PHOTOGRAPHIC FILM

Reference is hereby made to commonly assigned, copending U.S. patent application Ser. No. 774,715, entitled PHOTOGRAPHIC CAMERAS; Ser. No. 774,716, entitled PHOTOGRAPHIC FILM UNIT AND CARTRIDGE ASSEMBLY, and Ser. No. 774,719, entitled APPARATUS FOR SELECTIVELY VIEWING A PLURALITY OF RECORDING ELEMENTS, all filed in the name of Donald Malcolm Harvey; Ser. No. 774,717, entitled IMPROVED ROTARY FILM PROCESSING APPARATUS and Ser. No. 774,720, entitled IMPROVED VERTICAL PROCESSING APPARATUS, both filed in the name of William J. Hutchinson; Ser. No. 774,718, now abandoned, entitled IMPROVED HORIZONTAL FILM PROCESSING APPARATUS, filed in the name of Victor C. Solomon, and Ser. No. 774,721, entitled APPARATUS FOR PROCESSING PHOTOGRAPHIC FILM, filed in the name of David L. Patton, all filed on the same date as this application.

BACKGROUND OF THE INVENTION

1. Field of the Invention

The present invention relates to photographic processors and more specifically to processors for treating flat discrete elements of photographic film, particularly such elements having a disc shaped configuration.

2. Description of the Prior Art

Photographic processors are well known for use with film in a web format whereon image areas are disposed side by side along the length of the web. In a typical low volume processor such webs are wound on a reel and supported in such a manner that adjacent convolutions around the reel are not in physical contact. The reels may be placed in one or more tanks of processing solution and rotated in the solutions. Relative movement between the film and the processing solution improves the uniformity of development and displaces any foreign matter that may cling to the film. In a typical medium volume processor a number of such webs are suspended on racks which are successively dunked in tanks of processing solution. In this case, relative movement between the solution and the film is provided by mechanically agitating the solution. One agitating means, known as sparging, involves the introduction of bursts of gas, such as nitrogen, at the bottom of the tank. In larger volume processors, the webs are spliced together, end-to-end, and are continuously transported on rollers through a series of tanks containing the processing solutions. Transporting the film through the solutions provides some relative movement between the film and the solution.

In addition, means such as sparging have been employed in continuous web processors. In all of the processors noted above, it is desirable, at various stages in the process, to remove any excess solution that may be clinging to the webs. Removal of excess solution between successive treatments, for example, reduces inter solution contamination, and removal of excess solution before final drying permits the use of higher drying temperatures without causing rills or pits on the emulsion surface. Removal of this excess solution has been accomplished by various means such as sponges, air knives, and, most frequently, by means of a rubber squeegee blade. Such mechanical squeegeeing involves possibly detrimental mechanical contact with the image area of the film. After processing and printing, the webs are cut for return, along with the prints, to the customer.

Processors for discrete film units, especially in a disc format, are less well known, although versions of film discs and cameras that used them were first developed some time ago. The scarcity of the prior art of automatic processors for discrete elements of photographic film may indicate that the earlier versions of film discs were processed individually by hand or by some other labor intensive process.

More recently, discrete film elements having a generally disc shaped format have been developed for use in modern cartridges, and cameras adapted to utilize such cartridges have been developed. Such cameras and cartridges are more fully disclosed in the referenced U.S. patent applications Ser. No. 774,715 and Ser. No. 774,716, respectively. The film elements include a central hub of molded plastic that is permanently attached to a disc of photographic film. The molded hub has a central opening that includes a keyed hole by which the hub is adapted to be rotationally supported within the camera. Indexing ears on the molded hub are used for positioning successive exposure areas of the film in the exposure gate of the camera. After exposure, the film unit is adapted to be removed from the cartridge for processing. Since the camera and film unit were designed to be pocketable, the exposure areas on the film unit are relatively small. With such a small format, it becomes increasingly critical to avoid scratches and other defects in the image area of the film, since such defects would be greatly magnified during printing. Therefore in processing such film elements, it has been found to be extremely important to avoid any mechanical contact with the image areas of the film element to minimize the possibility of scratching the image area.

It is known in the art to process non-web format film, such as plate or rectangular sheets of film by attaching the film sheets to the periphery of a drum and rotating the drum in a tray of processing solution. See U.S. Pat. No. 3,693,529. It is also known to attach photographic plates to a carrier and rotate the carrier in a container of processing solution about an axis passing through the center of the plates. See U.S. Pat. No. 608,871. It is further known to attach plates to a circular disc and rotate the disc about its center in a container of processing solution. See U.S. Pat. No. 750,621. It is also known to remove excess processing solution and to dry film chips, such as dentral x-ray film, by clipping rectangular film chips to the periphery of a disc and after processing the film chips, by rotating the disc about its axis on a dental lathe. See U.S. Pat. No. 2,766,670.

SUMMARY OF THE INVENTION

Accordingly, it is an object of the present invention to provide a processor and processing method for discrete generally disc shaped elements of photographic film that avoid mechanical contact with the image area of the film as the film units are treated in the various processing steps.

It is a further object to provide a simple means and method for generating relative movement between the film elements and the processing solution.

Yet another object is to provide a processor and method that removes excess processing solution from the film element without mechanical contact with the image area of the film.

A still further object of the invention is to provide a processor capable of large volume processing of such discrete film elements.

These and other objects of the invention are accomplished by providing a processor and processing method where film elements are stacked in substantial parallel relation, rotated in a processing solution for treating the film units and rotated out of the processing solution for removing excess solution from the film elements.

DESCRIPTION OF THE DRAWINGS

In the detailed description of the preferred embodiment of the invention presented below, reference is made to the accompanying drawing in which.

DESCRIPTION OF THE PREFERRED EMBODIMENT

Because photographic processing apparatus and methods are well known, the present description will be directed in particular to elements forming part of, or cooperating directly with, the present invention. Elements are steps not specifically shown or described herein are understood to be selectable from those known in the art.

Figure 1:
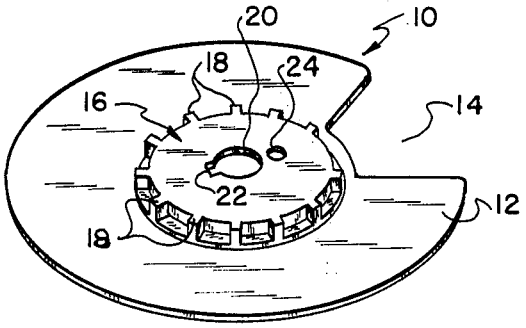
FIG. 1 is a top perspective view of a disc shaped film element of the type to be processed according to the present invention.
Figure 3:
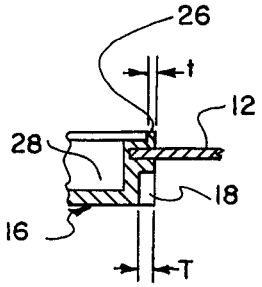
FIG. 3 is an enlarged, partial section of the film element taken along line 3—3 of FIG. 2.

As seen in FIG. 1, a film element generally designated 10, of the type to be processed according to the present invention, includes a film disc 12 having a segmental slot 14. A film support member comprising a molded plastic hub 16 is permanently attached to the center of the film disc 12 and includes indexing ears 18, and a spindle hole 20 with a key slot 22. As viewed from the underside (see FIG. 2), the molded plastic hub 16 includes a raised peripheral rim 26 and a recessed central portion 28. As can be seen in the sectional view in FIG. 3, the raised peripheral rim 26 has a thickness t slightly less than the thickness T of indexing ears 18 and has the same outside diameter as indexing ears 18, the purpose of which will be explained below.

Figure 4:
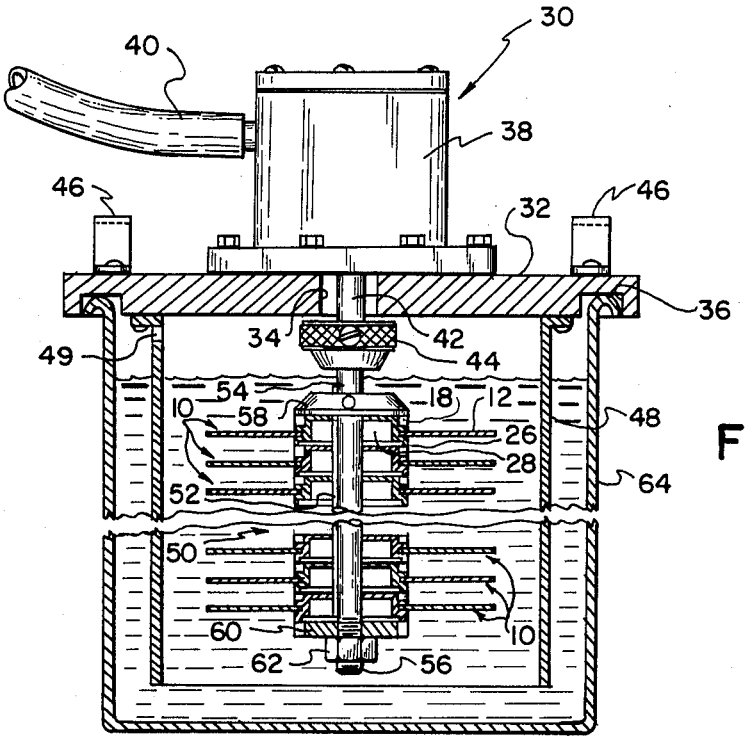
FIG. 4 is a plan view of a processor according to the subject invention, shown partially in section.

One embodiment of a processor according to the present invention will now be described with reference to FIG. 4. The spin processor generally disignated 30 includes a base 32 having a central opening 34 and a peripheral groove 36. A motor 38, shown for the sake of example as a pneumatic motor but which also could be an electric motor, has an air supply 40, a shaft 42, and a chuck 44. This motor is mounted on top of base 32 so that shaft 42 extends through central opening 34. A pair of handles 46 are also mounted on the top of base 32. A cylindrical splash guard 48 is mounted on the bottom of base 32 and is centered around shaft 42. A hole 49 is provided in the splash guard so that a chuck wrench may be inserted to operate chuck 44. A spindle generally designated 50 has a keyed central portion 52, a top end portion 54 that is adapted to be received in chuck 44 and a threaded bottom end portion 56. A top washer 58 and a bottom washer 60 having ears similar to indexing ears 18 of hub 16 are adapted to be placed at either end of the central portion 52 of spindle 50 and a retaining nut 62 fits on the threaded end 56 of spindle 50. Top washer 58 is attached to spindle 50, but bottom washer 60 is removable and is held on the spindle by nut 62. The processor is shown placed over a container 64 of processing solution. In this position, the lip of container 64 is received by peripheral groove 36 of base 32.

Figure 2:
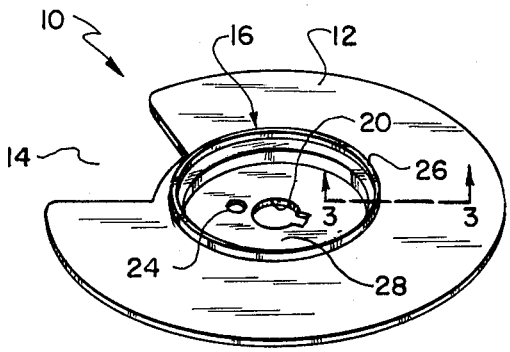
FIG. 2 is a bottom perspective view of the film element shown in FIG. 1.

After the film elements 10 have been removed from the cartridge, they are placed on spindle 50 in stacked relation and are held on the spindle between top washer 58 and bottom washer 60 by retaining nut 62. The key on the central portion 52 of spindle 50 cooperates with the key slots 22 in the film elements to prevent the film elements from rotating relative to spindle 50. When the film elements are stacked on spindle 50 and secured by retaining nut 62, the spindle can be used to handle the film elements without touching the image areas thereon. After the spindle 50 is loaded with film elements, its top end 54 is secured in chuck 44 of the processor. When the processor is lowered into container 64, filled to the proper level with processing solution (as shown in FIG. 2), all of the film elements are beneath the surface of the processing solution.

When the film elements are stacked on the spindle, raised peripheral rim 26 of the molded plastic hub of each film element rests on the indexing ears 18 of the hub immediately below it. Since rim 26 is narrower than indexing ears 18, passageways are thereby provided from the cavity formed by the recessed central portion of the molded plastic hub so that any processing solution trapped between the hubs may escape during the removal of excess processing solution as described below.

Figure 5:
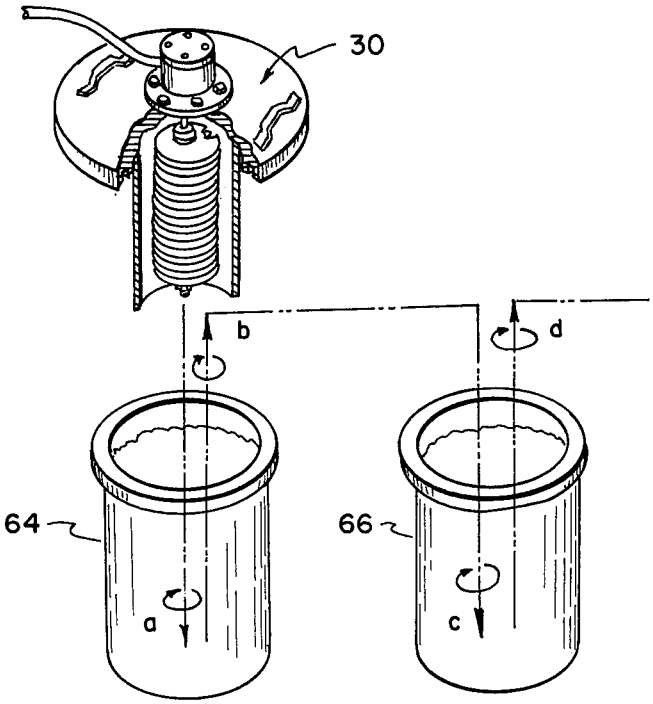
FIG. 5 is an illustration of the method of operation of a processor according to the present invention, the processor shown partially broken away.

The operation of the processor will now be described with reference to FIG. 5. Two containers containing two different processing solutions are shown by way of example in FIG. 5. However, the number of solutions could be more or less depending upon the nature of the process. To begin the processing, motor 38 is energized to rotate shaft 42 and thereby rotate spindle 50 bearing the film elements. The operator, holding the processor by handles 46, places the processor over the first container of processing solution 64 and lowers the processor into the processing solution to the position shown in FIG. 4. The film elements are rotated while in the processing solution (shown as position "*a*" in FIG. 5) for a predetermined processing time. The rotation of the film elements provides the required relative motion between the film and the processing solution. After a predetermined time, the operator lifts the processor out of the processing solution (position "b") while the spindle continues to rotate. Rotating the film elements after they have been withdrawn from the solution tends to expel, by centrifugal force, excess solution that may tend to cling to the film as it is removed from container 64. The excess solution thus expelled from the rotating film elements is trapped by cylindrical splash guard 48 and drips back into the solution container. The operator then positions the processor over the next container of processing solution 66 and repeats the steps of spinning the discs in the processing solution (position "*c*") and out of the processing solution (position "*d*"). The processing steps of spinning the elements in solution and then out of solution are repeated for as many different solutions as are required to completely treat the film. After processing in all the solutions has been completed, the elements are spun until dry.

Figure 6:
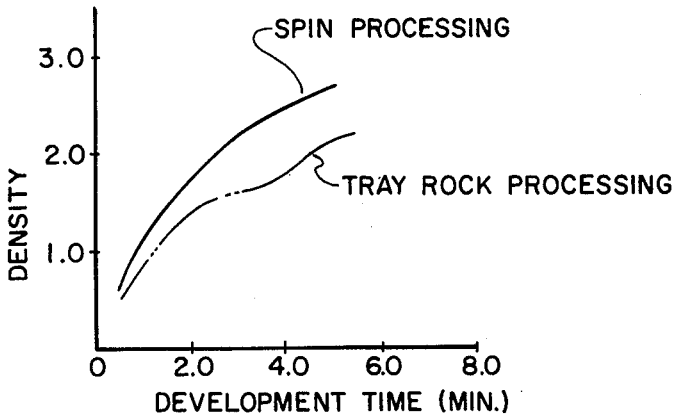
FIG. 6 is a graph comparing the results of processing film elements according to the present invention versus conventional tray processing.

An experiment to determine the relative processing efficiency of spin processing versus a more traditional technique of placing the film elements in a tray of processing solution and rocking the tray to provide agitation was conducted and the results are plotted in FIG. 6. A series of film elements were identically exposed for five seconds to tungsten illumination. The thus exposed film elements were processed for varying amounts of time by both the spin processing method and the more conventional method of placing the elements in a tray of processing solution and rocking the tray. The processed elements were evaluated by means of a densitometer and the results were plotted to show density versus processing time. As can be seen from the graph, spin processing yielded a higher developed film density for comparable processing times.

The invention has been described in detail with particular reference to a preferred embodiment thereof, but it will be understood that variations and modifications can be effected within the spirit and scope of the invention.

I claim:

1. Apparatus for processing in a bath of processing solution a plurality of individual photographic film elements, each film element having a centrally-apertured hub having a predetermined thickness and a flat image support having a predetermined thickness less than the thickness of the hub; said apparatus comprising:

an elongate spindle adapted to extend through the hub apertures to receive the film elements;

means for inhibiting relative rotation between said spindle and the film elements, whereby rotation of said spindle on its longitudinal axis will rotate the film elements on such axis;

means for retaining the film elements in side-by-side relationship with the hubs in contact and with the image supports positioned normal to the longitudinal axis of the spindle and in spaced parallel relationship with each other;

means for supporting the spindle with the retained film elements in contact with the bath of processing solution; and drive means for rotating said spindle with the film elements in contact with the solution to agitate the film elements in the solution and thereby enhance the contact between the film elements and the solution.

2. Apparatus for processing in a bath of processing solution a plurality of photographic film elements, each film element including a centrally-apertured hub having a predetermined thickness and a flat image support having a predetermined thickness less than that of the hub; said apparatus comprising:

an elongate spindle adapted to extend through the hub apertures to receive the film elements;

means for inhibiting relative rotation between said spindle and the film elements, whereby rotation of said spindle on its longitudinal axis will rotate the film elements on such axis;

means for releasably retaining the film elements in side-by-side relationship with their hubs in contact and their image supports spaced in parallel relationship to each other; and drive means for rotating said spindle, said spindle being rotatable by said drive means with the film elements in contact with the solution bath, to agitate the film elements in the solution, and with the film elements out of contact with the solution bath to remove excess solution from the film elements.

3. Apparatus for processing film discs in photographic processing solutions to establish visibly perceivable images from latent images, each film disc defining a central hub having an aperture therethrough, and a planar element having a thickness less than that of the hub, containing the latent images; and apparatus comprising:

an elongate spindle adapted to extend through the hub apertures for receiving a plurality of the film discs, and spindle having a longitudinal axis and including means for supporting the film discs with their planar elements generally normal to said axis;

means for inhibiting relative rotation between said spindle and the film discs, whereby rotation of said spindle on its longitudinal axis will rotate the film discs on such axis;

means for releasably retaining the discs on said spindle with their hubs in engagement one with another and with their planar elements in closely spaced parallel relationship;

drive means for spinning the spindle on its longitudinal axis to spin the film discs on such axis; and means for supporting the spindle with the spinning film discs in contact with the processing solution to agitate the discs in the solution.

4. Apparatus for treating, in a container of photographic processing solution, a plurality of disc-shaped photographic film elements, each film element including an image support and an apertured hub having a thickness greater than that of the image support; said apparatus comprising:

a shaft adapted to be inserted through the apertures in the hubs of the film elements for supporting the film elements normal to the longitudinal axis of the shaft;

means for releasably retaining the film elements on the shaft and for inhibiting relative rotation between the film elements and the shaft, whereby rotation of the shaft on its longitudinal axis will rotate the film elements on such axis; and means for rotating the shaft on its longitudinal axis with the film elements in contact with the processing solution for treating the film elements in the solution, and for rotating the shaft on its longitudinal axis with the film elements out of contact with the processing solution for removing excess processing solution from the elements.

5. Apparatus for treating, in a container of photographic processing solution, a plurality of disc-shaped photographic film elements, each film element including an image support and a central hub having a thickness greater than that of the image support, the hub having an aperture and a keyway therein; said apparatus comprising:

a shaft adapted to be inserted through the apertures in the hubs of the film elements for supporting the film elements on the longitudinal axis of said shaft;

means for releasably retaining the film elements on the shaft with the hubs of the film elements in contact, thereby to maintain the image supports in closely spaced parallel relationship;

a key on a shaft engageable with the keyways in the hubs to prevent relative rotation between the film elements and the shaft, whereby rotation of the shaft on its longitudinal axis will rotate the film elements on such axis;

means for rotating said shaft and the film elements on the longitudinal axis, said shaft and the film elements being rotatable in contact with the processing solution, for treating the film elements in the solution, and out of contact with the processing solution to remove excess processing solution from the elements; and means for supporting said shaft with the film elements in the processing solution during rotation of said shaft and the film elements by said rotating means.

6. A method of treating in a processing solution generally flat circular elements of photographic film, each element having a planar image support and a hub which is thicker than a support, said method comprising the steps of:

supporting a plurality of the elements on a common axis with adjacent hubs in contact, thereby to closely space the image supports in parallel relationship perpendicular to the axis;

contacting the supported elements with a bath of processing solution to treat the elements in the solution;

rotating the elements on the common axis to enhance the treatment of the elements in the solution;

removing the elements from contact with the solution; and rotating the elements on the common axis out of contact with the solution to evenly spread and remove excess of the solution from the elements.

7. A method of treating a plurality of discrete photographic elements in a processing solution, each element having a hub provided with a central aperture having a keyway, and a planar image support which is thinner than the hub; said method comprising the steps of:

a. stacking the plurality of elements on a spindle having an elongate key, with the key extending through the keyways in the hubs to prevent relative rotation between the elements and the spindle, and with the hubs of adjacent elements engaging one another to position the image supports of adjacent elements in spaced parallel relationship;

b. immersing the elements with the processing solution to treat the elements in the solution;

c. rotating the spindle and the elements immersed in the solution to enhance contact between the elements and the solution;

d. removing the elements from the solution; and e. rotating the spindle with the elements out of the solution to remove excess processing solution from the elements.

8. A method of treating elements of photographic film in a plurality of processing solutions to develop latent images in the film elements, the film elements having an image support of one thickness and a centrally apertured hub of a second greater thickness; said method comprising the steps of:

a. mounting the elements on a spindle with the hubs of adjacent elements in contact and such that rotation of the spindle on its longitudinal axis will rotate the elements on such axis;

b. contacting the elements with a first processing solution for treating the elements in the first solution;

c. rotating the spindle to spin the elements in contact with the first processing solution to enhance the contact between the elements and the first solution while agitating the first solution;

d. removing the elements from contact with the first processing solution;

e. rotating the spindle and the elements to remove excess of the first processing solution;

f. contacting the elements with a second processing solution to treat the elements with the second solution;

g. rotating the spindle to spin the elements while in contact with the second processing solution to enhance the contact between the elements and the second solution while agitating the second solution;

h. removing the elements from contact with the second processing solution;

i. rotating the spindle to spin the elements to remove excess of the second processing solution; and j. rotating the spindle to spin the elements to facilitate drying of the elements.

* * * * *

UNITED STATES PATENT AND TRADEMARK OFFICE

CERTIFICATE OF CORRECTION

PATENT NO. : 4,112,454

DATED : September 5, 1978

INVENTOR(S) : Donald Malcolm Harvey

It is certified that error appears in the above-identified patent and that said Letters Patent are hereby corrected as shown below:

Column 6, line 12, change "and" to --said--;
line 16, change "and" (first occurrence) to --said--.
Column 7, line 20, change "a" to --the--.

Signed and Sealed this

Sixth Day of March 1979

[SEAL]

*Attest:*

RUTH C. MASON
*Attesting Officer*

DONALD W. BANNER
*Commissioner of Patents and Trademarks*